US008602917B2

(12) United States Patent
Bennett

(10) Patent No.: US 8,602,917 B2
(45) Date of Patent: Dec. 10, 2013

(54) MANIPULATOR WITH STABILISER

(71) Applicant: Northcroft Golf Limited, Berkshire (GB)

(72) Inventor: John H. Bennett, Hungerford (GB)

(73) Assignee: Northcroft Golf Limited, Berkshire (GB)

( * ) Notice: Subject to any disclaimer, the term of this patent is extended or adjusted under 35 U.S.C. 154(b) by 0 days.

(21) Appl. No.: 13/673,032

(22) Filed: Nov. 9, 2012

(65) Prior Publication Data

US 2013/0130842 A1 May 23, 2013

(30) Foreign Application Priority Data

Nov. 18, 2011 (GB) ..... 1119914.8

(51) Int. Cl.
*A63B 57/00* (2006.01)

(52) U.S. Cl.
USPC ..... 473/386

(58) Field of Classification Search
USPC ..... 473/386, 286; 135/65, 66, 77, 80, 81, 135/70; 294/19.2
See application file for complete search history.

(56) References Cited

U.S. PATENT DOCUMENTS

| | | | | | |
|---|---|---|---|---|---|
| 2,596,733 | A | * | 5/1952 | Sibner | 135/81 |
| 2,667,885 | A | * | 2/1954 | Prete | 135/81 |
| 3,105,715 | A | * | 10/1963 | Happ | 294/61 |
| 3,904,200 | A | * | 9/1975 | Jackle et al. | 473/133 |
| 4,200,322 | A | * | 4/1980 | Smith | 294/104 |
| 4,313,604 | A | | 2/1982 | Baxter | |
| 4,364,405 | A | * | 12/1982 | Norwood et al. | 135/70 |
| 4,589,661 | A | | 5/1986 | Attig | |
| 4,616,826 | A | * | 10/1986 | Trefts | 473/133 |
| 4,714,250 | A | | 12/1987 | Henthorn | |
| 4,819,938 | A | * | 4/1989 | Hill | 473/133 |
| 4,827,956 | A | * | 5/1989 | Toot | 135/66 |
| 4,951,947 | A | | 8/1990 | Kopfle | |
| 4,966,316 | A | * | 10/1990 | George et al. | 135/66 |
| 5,205,598 | A | | 4/1993 | Miller | |

(Continued)

FOREIGN PATENT DOCUMENTS

| | | | | |
|---|---|---|---|---|
| GB | 2122077 A | * | 1/1984 | A45B 3/00 |
| GB | 2 294 404 A | | 5/1996 | |

(Continued)

OTHER PUBLICATIONS

UK Search Report for corresponding UK Application No. GB1119914.8 dated Mar. 8, 2012.

*Primary Examiner* — Steven Wong
(74) *Attorney, Agent, or Firm* — Renner, Otto, Boisselle & Sklar, LLP

(57) ABSTRACT

This invention relates to an improved device for manipulating objects on the ground, and more specifically, but not exclusively, to an improved device for teeing a golf ball. A hand operated device is disclosed for manipulating an object on the ground from a standing position, comprising a manipulator, shaft, control mechanism and a stabilizer. The manipulator is carried at one end of the shaft and the stabilizer comprises a ground engaging foot and a resilient member to urge the foot to an extended position. The manipulator and stabilizer are arranged such that the foot engages with the ground, and as the manipulator is moved towards the ground against the urging of the resilient member, the foot remains engaged with the ground to stabilize the device while the control mechanism is operated to manipulate the object.

17 Claims, 2 Drawing Sheets

(56) References Cited

U.S. PATENT DOCUMENTS

| | | | | |
|---|---|---|---|---|
| 5,330,177 | A | 7/1994 | Rogge | |
| 5,330,178 | A * | 7/1994 | Geishert, Sr. | 473/386 |
| 5,433,234 | A * | 7/1995 | Lapere | 135/66 |
| 5,503,394 | A * | 4/1996 | Mauck et al. | 473/386 |
| 6,053,821 | A * | 4/2000 | Palmer | 473/386 |
| 6,461,254 | B1 | 10/2002 | Ballett et al. | |
| 6,951,224 | B2 * | 10/2005 | Garrett | 135/66 |
| 2002/0193183 | A1 | 12/2002 | Aikman | |
| 2004/0029653 | A1 | 2/2004 | Whitehill et al. | |
| 2005/0255929 | A1 | 11/2005 | Naus, Jr. | |
| 2007/0219014 | A1 | 9/2007 | Merriman | |
| 2008/0280700 | A1 * | 11/2008 | Ritchie, Jr. | 473/386 |
| 2012/0060878 | A1 * | 3/2012 | Thiessens | 135/66 |

FOREIGN PATENT DOCUMENTS

| | | | |
|---|---|---|---|
| GB | 2 474 453 | A | 4/2011 |
| JP | 11-262550 | A | 9/1999 |
| WO | 99/44695 | | 9/1999 |
| WO | 00/44448 | | 8/2000 |

* cited by examiner

MANIPULATOR WITH STABILISER

CROSS-REFERENCE TO RELATED APPLICATION

The present application claims priority under 35 USC §119 to UK Patent Application No. 1119914.8 filed on Nov. 18, 2011, the entire disclosure of which is incorporated herein by reference.

TECHNICAL FIELD OF THE INVENTION

This invention relates to an improved device for manipulating objects on the ground, and more specifically, but not exclusively, to an improved device for teeing a golf ball.

Playing golf requires that the golfer is able to pick the ball up from, and place the ball on to the playing surface, and further requires the ability to tee up a golf ball. The teeing, placement and collection of balls from the ground normally requires that the golfer bends, which can be challenging for disabled or elderly players. A number of devices exist for assisting the player in performing these tasks, which are generally mounted on the handle of a golf club or a similar elongate shaft.

DESCRIPTION OF THE RELATED ART

Teeing a golf ball with such a device can be relatively challenging, since the ball needs to be accurately placed on the relatively small tee, and can easily be knocked off as the device is withdrawn. GB2294404 discloses a device in which the ball and tee are gripped in the same jaws, allowing the ball to be placed on the tee by hand from a standing position, and the ball on the tee to be placed in one operation. Although this type of device allows teeing without bending remotely, it still requires a steady hand in use, since the ball can easily be knocked off the tee as the device is withdrawn.

SUMMARY OF THE INVENTION

According to an embodiment of the present invention there is provided a hand operated device for manipulating an object on the ground from a standing position, comprising: an elongate shaft; a manipulator for manipulating the object; a hand operated control mechanism for controlling the manipulator, the manipulator and control mechanism being spaced apart along the shaft to allow manipulation of the object on the ground from a standing position; and a stabiliser for stabilising the device during manipulation of the object; wherein the stabiliser comprises a piston which is arranged to move axially within a tube which, in use, is secured adjacent to and substantially parallel with the shaft, a ground engaging foot and a resilient member arranged to urge the foot towards an extended position; wherein the stabiliser is stowable away from the manipulator when stabilisation is not required; and wherein the manipulator and stabiliser are arranged such that the foot engages in use with the ground, and as the manipulator is moved further towards the ground against the urging of the resilient member, and into an operating position, the foot remains engaged with the ground to stabilise the device while the control mechanism is operated to manipulate the object.

Manipulating may comprise picking the object up from the ground; and/or placing the object on the ground; and/or inserting the object at least partly into the ground.

The manipulator may comprise a gripper with opposed pivoting jaws.

The manipulator may be adapted for holding a golf ball.

The manipulator may be adapted for holding and insert a golf tee.

The manipulator may be adapted for holding a golf ball and a tee, and for inserting the tee with the golf ball resting on it.

The stabiliser and manipulator are arranged so that the foot is at least partially retracted from the extended position by inserting a tee into the ground with the manipulator.

In use, the foot may remains engaged with the ground until the manipulator may be moved laterally without dislodging the golf ball from the tee.

The stabiliser may comprise a piston which moves axially within a tube.

The resilient member may comprise a helical spring which is coaxial with the piston.

The tube may be secured parallel with the shaft.

The stabiliser may be stowed away from the manipulator when stabilisation is not required. The stabiliser may be slideably mounted on the shaft. The stabiliser may be pivotally mounted on the main shaft, so that rotating the mechanism about the pivotal mounting point moves the foot away from the manipulator.

When a standard tee is carried in the manipulator, the foot may engage with the ground before the tee engages with the ground.

The foot may have a range of movement of at least 20 mm. The range of movement of the foot may be less than 75 mm. The range of movement of the foot may be between 25 mm and 50 mm.

The foot may comprise a rubber and/or plastics material. The foot may comprise a spike.

BRIEF DESCRIPTION OF THE DRAWINGS

The invention will now be described, by way of example, with reference to the following drawings in which.

DETAILED DESCRIPTION OF THE INVENTION

Figure 1:
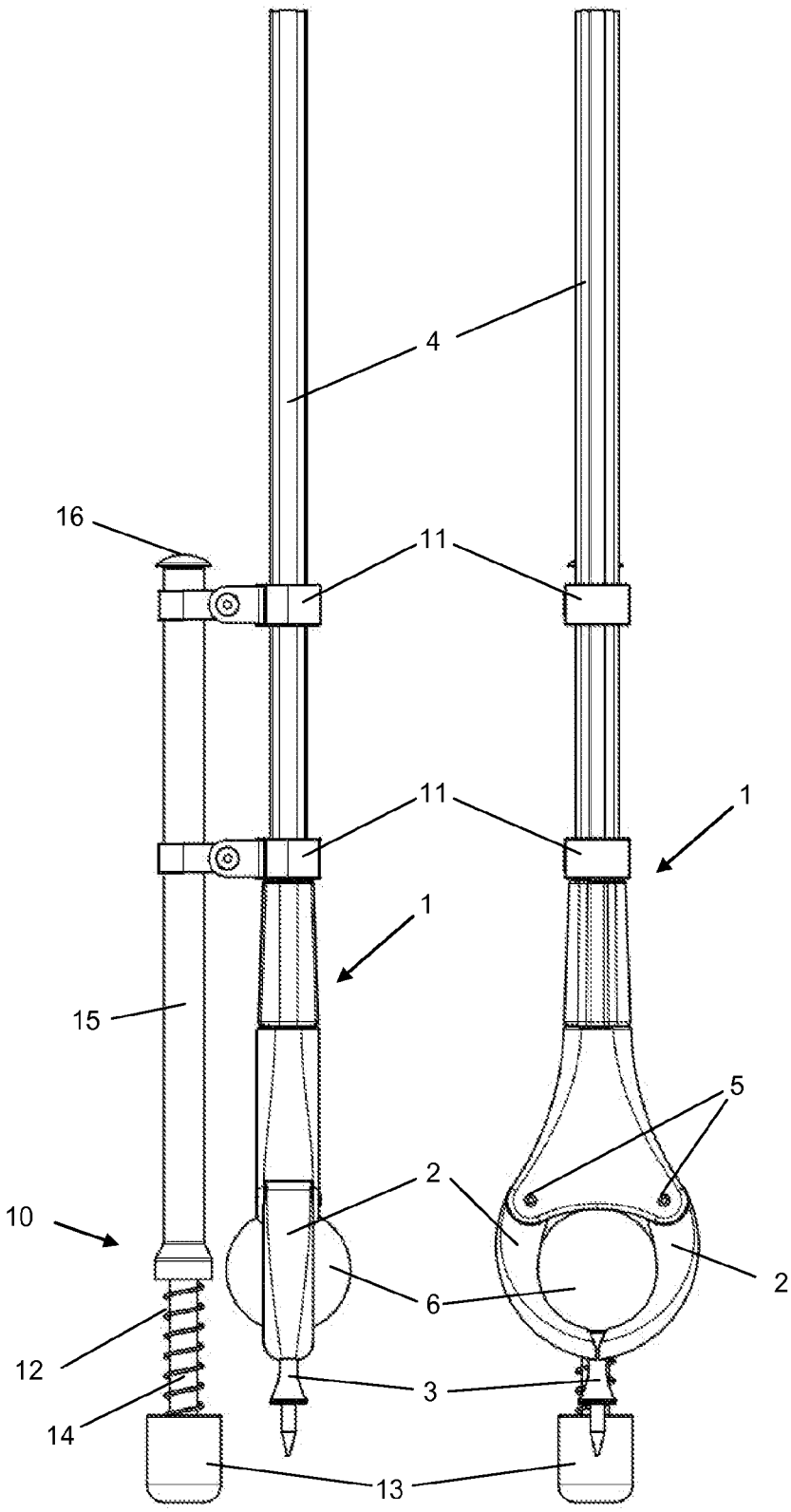
FIG. 1 shows side and front views of an embodiment of the invention in a first position.
Figure 2:
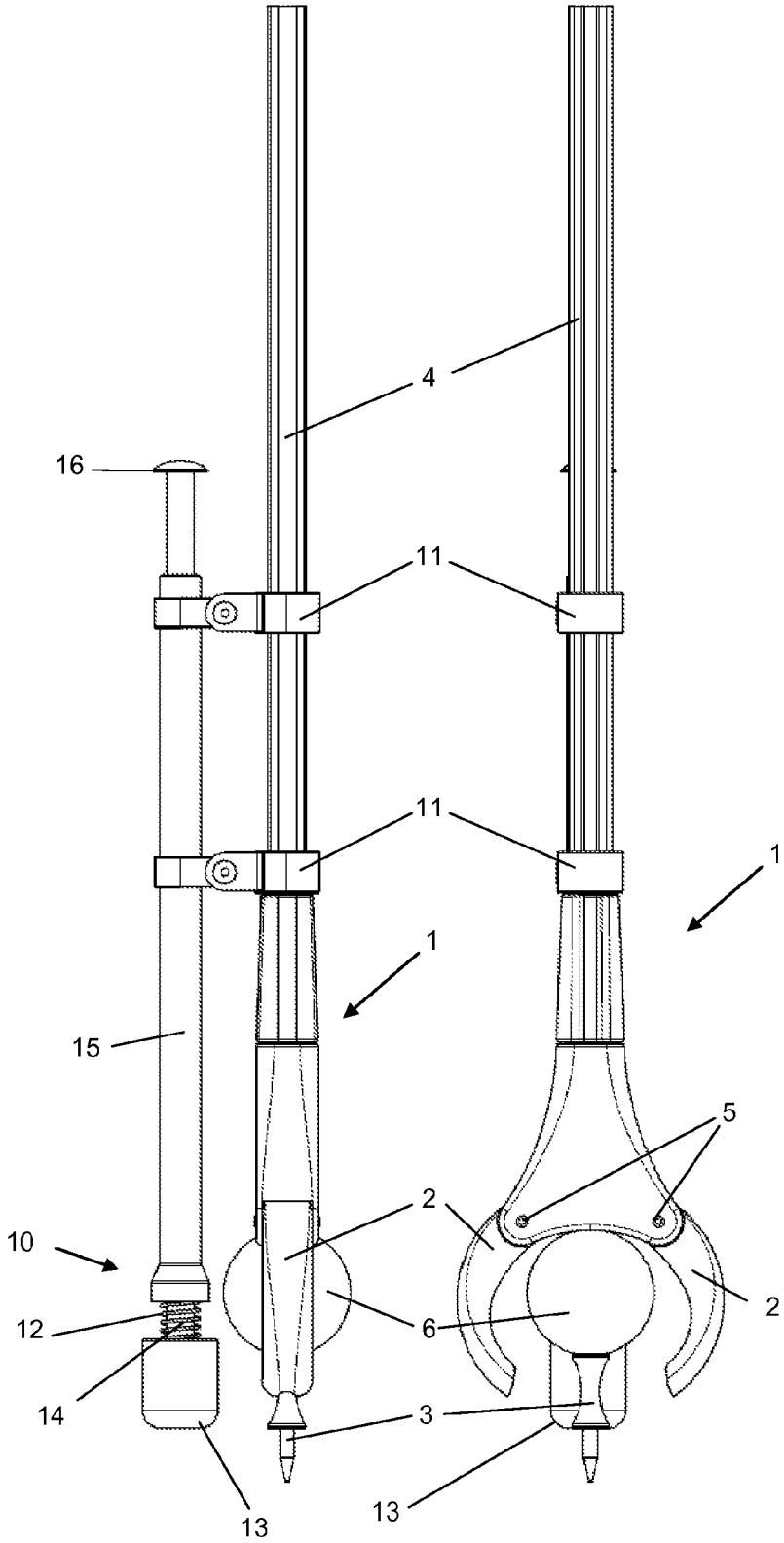
FIG. 2 shows side and front views of an embodiment of the invention in a second position.

The drawings depict a hand operated teeing device 1, which can be used from a standing position to tee up a golf ball ready for address by a golfer. The teeing device comprises a gripper having a pair of opposed jaws 2, which are attached at one end of a shaft 4 at pivots 5. A hand grip and trigger mechanism (not shown) is provided at the other end of the shaft 4, by which the jaws 2 may be opened and closed. Pulling the trigger results in the jaws 2 closing, and releasing the trigger results in the jaws 2 opening (or vice versa in an alternative arrangement). FIG. 1 shows the jaws 2 in the closed position, and FIG. 2 shows them in the open position.

In use the jaws 2 can hold a golf ball 6 and tee 3, allowing the tee 3 to be placed in the ground with the golf ball 6 in place atop the tee 3. When the trigger is released the jaws 2 open and the ball 6 is left resting on the tee 3. The player may thereby tee the ball 6 remotely without having to bend.

There can however be a problem if the player inadvertently moves the jaws 2, after the ball 6 and tee 3 have been released, in a manner that can dislodge the ball 6. Because the ball 6 is merely balanced on the tee a relatively light contact is sufficient to cause it to fall onto the ground, whereby a further attempt to place the ball 6 and remove the jaws 2 without dislodging it must be made. This can be a particular problem in windy conditions or if the player suffers from a complaint that causes trembling hands. Players wishing to avoid bending may be more likely to suffer from reduced dexterity.

It therefore desirable that the device 1 is made more easily controllable by the player so that it is less likely to waver and consequently knock the ball 6 from the tee 3 as it is removed after teeing up.

Accordingly, a stabiliser 10 is provided comprising brackets 11, a tube 15, piston 14, a spring 12 and a ground engaging foot 13. The tube 15 is secured adjacent and substantially parallel to the main shaft 4 of the teeing device 1 by two brackets 11. The piston 14 is longer than the tube 15, and is arranged inside the tube 15 so that it can slide coaxially therein. The ground engaging foot 13 is secured to the piston 14 at a first end of the piston 14 adjacent to the jaws 2, and a limit stop 16 is secured to the piston 14 at the second end of the piston 14 (remote from the jaws 2). Neither the foot 13 nor the limit stop 16 can fit inside the tube 15, and they thereby secure the tube 15 around the piston 14, and limit axial movement of the piston 14 therein.

A helical spring 12 is arranged around the piston 14 between the tube 15 and the foot 13. The helical spring 12 is a compression spring which urges the piston 14 in a direction which extends the distance between the foot 13 and the tube 15 (i.e. the spring 12 urges the foot 13 downwards, in use). The spring 12 is arranged so that it is under compression throughout the range of movement of the piston 12.

The stabiliser 10 is arranged such that as the teeing device 1 is used to insert a golf tee 3 into the ground, the foot 13 engages first with the ground and the spring 12 begins to compress. Once the foot 13 engages with the ground the device is steadied and further movement of the teeing device 1, to move the jaws 2 towards an operating position in which the jaws 2 can be opened to release the ball 6, is substantially restricted to axial movement corresponding to axial movement of the piston 14 within the tube 15.

The stabiliser 10 is arranged so that the foot 13 makes contact with the ground before the spike of a standard tee. Whilst it is preferable that the foot 13 engages with the ground before the spike of the tee, the device 1 would still operate satisfactorily if the spike of the tee 3 engaged the ground shortly before the foot 13, since at that moment the jaws 2 are still firmly holding the ball 6 and tee 3. For example, using a tee 3 that is longer may result in the tee 3 engaging with the ground before the foot 13, and it is therefore the case that alternative arrangements of the stabiliser 10 may result in a standard tee 3 engaging the ground before the foot. The stabiliser 10 and teeing device 1 are arranged so that the foot 13 engages with the ground before the tee 3 is fully inserted into the ground, or in other words before the ball 6 is at its final position and ready to be released.

When the jaws 2 have been lowered such that the ball 6 is at the desired height (with the jaws 2 being in an operating position), the foot 13 remains engaged with the ground through the action of the spring 12; the stabilisation thus provided allows the jaws 2 may be opened by operating the trigger mechanism with the minimum movement of the main shaft 4 after the tee 3 has been inserted in the ground. The range of movement and attachment of the stabiliser 10 to the teeing device 1 is arranged so that the foot 13 remains engaged with the ground until the jaws 2 are moved a sufficient distance from the ball 6 (balanced atop the tee 3) to mitigate the chance of the ball 6 being inadvertently dislodged from the tee 3 during this procedure. The jaws 2 may subsequently be moved laterally away from the ball 6.

Golf tees 3 of varying lengths are frequently used, depending on the club and the player's preference. The use of different golf tees may result in variations in the height above the ground at which the ball 6 rests on the tee 3. The range of movement of the piston 12, the spring 14 and the initial position of the foot 13 are chosen to accommodate a range of such positions, and to accommodate the various lengths of golf tees that are in popular use. A standard length for a golf tee is 54 mm (2.125 inches) and the maximum tee length (defined by the rules of the game) is 101.6 mm (4 inches).

Although an embodiment of the present invention has been described with reference to a specific teeing device, the invention is not so limited. The application of the device to other teeing devices (including those known in the prior art) is contemplated.

Furthermore, the stabilisation device has other applications apart from use on a golf course. For example, devices generically known as litter pickers are supplied with a variety of attachments which allow other uses and may in particular be of benefit to older people. Very often infirmities (for example resulting from old age) not only preclude or limit bending but also limit fine control over hands. The stabilisation device therefore may applied in a range of other contexts that require stabilisation.

In general, the present invention is applicable to any context in which a hand operated device is used for manipulating an object on the ground from a standing position. Such a device would have an elongate shaft, a manipulator for manipulating the object, a hand operated control mechanism for controlling the manipulator, with the manipulator and control mechanism being spaced apart along the shaft to allow manipulation of the object on the ground from a standing position, and a stabiliser for stabilising the device during manipulation of the object. In the context of the embodiment shown in FIGS. 1 and 2, the object would be the golf ball 6 and tee 3, and the manipulator would be the gripper (jaws) 2; manipulation of the object would be placing the ball 6 and tee 3 on the ground (or at least partly into the ground in the case of the tee 3). The device of FIGS. 1 and 2 could even be employed to pick a golf ball 6 up from the ground, with the stabiliser 15 helping to stabilise the device whilst the jaws 2 are enclosed around the ball 6, though such a device would benefit from having a further pair of opposed jaws so as more fully to enclose the ball 6 and to make it easier to pick up.

The embodiment described herein benefits from the stabiliser 10 being in place permanently, but it is contemplated that it may be useful to arrange the mounting means such that the stabiliser 10 could be stowed so that the foot 13 was clear of the jaws 2. Quick release brackets (for example incorporating cams) may be used to enable the stabiliser 10 to be moved along the main shaft 4 away from the gripper end. As an alternative, one of the clamps 11 could be substituted for a removable clip, with the other clamp providing pivotal attachment to the main shaft 4. The stabiliser could be then be stowed by detaching the removable clip, rotating the stabiliser 10 about the pivotal attachment, and re-attaching the removable clip.

Although the stabiliser has been described with a foot mounted on a retractable mechanism that constrains lateral movement whilst allowing the grippers to move axially, the invention is not so limited, and the stabiliser may instead limit movement of the gripper to other prescribed paths. Although a stabiliser has been disclosed that comprises an axially retractable tube and piston, alternative arrangements are contemplated as within the scope of the invention, including but not limited to linkage arrangements, elastic flexures and pivoting arrangements. A helical compression spring has been disclosed, but other resilient members can be used to urge the foot towards the extended position, for example an elastomeric spring, an air spring or an elastic flexure.

The embodiments described herein is given by way of example only, and various other modifications will be apparent to persons skilled in the art without departing from the scope of the invention, as defined by the appended claims.

Substantial improvements have been disclosed in relation to hand operated devices for remotely manipulating objects on the ground from a standing position by providing a stabilising foot that engages with a fixed surface such as the ground to stabilise the movement of the gripper during use. Mounting the foot on a mechanism that constrains movement to a fixed path facilitates more precise movement of the manipulators. For the example application of a teeing aid, the path through which the grippers are constrained to move by the foot and associated mechanism reduces the potential for dislodging the ball from the tee on withdrawal of the grippers.

Although the invention has been shown and described with respect to certain preferred embodiments, it is obvious that equivalents and modifications will occur to others skilled in the art upon the reading and understanding of the specification. The present invention includes all such equivalents and modifications, and is limited only by the scope of the following claims.

The invention claimed is:

1. A hand operated golf teeing device for teeing a golf ball on the ground from a standing position, comprising:

an elongate shaft;

a manipulator for manipulating and holding a golf ball and a tee;

a hand operated control mechanism for controlling the manipulator, the manipulator and control mechanism being spaced apart along the shaft to allow manipulation of the golf ball and tee on the ground from a standing position; and a stabiliser for stabilizing the device during manipulation of the golf ball and tee;

wherein the stabiliser comprises a piston which is arranged to move axially within a tube which, in use, is secured to the shaft and is adjacent to and substantially parallel with the shaft, a ground engaging foot and a resilient member arranged to urge the foot towards an extended position;

wherein the stabiliser is stowable away from the manipulator when stabilization is not required; and wherein the manipulator and stabiliser are arranged such that the foot engages in use with the ground, and as the manipulator is moved towards the ground against the urging of the resilient member, and into an operating position, the foot remains engaged with the ground to stabilize the device while the control mechanism is operated to manipulate the golf ball and tee.

2. The device of claim 1, wherein manipulating comprises:

picking the golf ball and tee up from the ground; and/or placing the golf ball and tee on the ground; and/or inserting the tee at least partly into the ground.

3. The device of claim 1, wherein the manipulator comprises a gripper with opposed pivoting jaws.

4. The device of claim 1, wherein when a standard tee is carried in the manipulator, the foot engages with the ground before the tee engages with the ground.

5. The device of claim 1, wherein the manipulator is adapted for holding a golf ball and a tee, and for inserting the tee with the golf ball resting on it, such that the object comprises a golf ball and tee.

6. The device of claim 1, wherein the stabiliser and manipulator are arranged so that the foot is at least partially retracted from the extended position by inserting a tee into the ground with the manipulator.

7. The device of claim 5, wherein, in use, the foot remains engaged with the ground until the manipulator may be moved laterally without dislodging the golf ball from the tee.

8. The device of claim 1, wherein the resilient member comprises a helical spring which is coaxial with the piston.

9. The device of claim 1, wherein the stabiliser is slideably mounted on the shaft.

10. The device of claim 1, wherein the stabiliser is pivotally mounted on the shaft, so that rotating the stabiliser about the pivotal mounting point moves the foot away from the manipulator.

11. The device of claim 1, wherein the foot has a range of movement of at least 20mm.

12. The device of claim 1, wherein the range of movement of the foot is less than 75 mm.

13. The device of claim 1, wherein the range of movement of the foot is between 25mm and 50mm.

14. The device of claim 1, wherein the foot comprises a rubber and/or plastics material.

15. The device of claim 1, wherein the foot comprises a spike.

16. The device of claim 1, wherein the ground engaging foot comprises a predominately flat ground engaging surface.

17. The device of claim 1, wherein a cross-section of the foot is large enough such that the foot cannot enter the tube.

* * * * *